United States Patent [19]

Goughnour

[11] 3,957,405

[45] May 18, 1976

[54] SLIP FORM HAVING HINGED GATE MEANS

[75] Inventor: Roy R. Goughnour, Jackson, Mich.

[73] Assignee: A. C. Aukerman Co., Jackson, Mich.

[22] Filed: May 28, 1974

[21] Appl. No.: 473,345

[52] U.S. Cl. ..... 425/63; 404/98; 404/105; 425/64

[51] Int. Cl.[2] ..... B28B 13/02

[58] Field of Search ..... 425/63–65, 425/59, 219, 432, 456; 404/98, 100, 105–106, 108; 49/324, 339–340

[56] References Cited

UNITED STATES PATENTS

| | | | |
|---|---|---|---|
| 2,239,029 | 4/1941 | Barrett | 49/340 |
| 2,932,875 | 4/1960 | Butcher | 425/59 |
| 3,123,883 | 3/1964 | Peirsol et al. | 425/59 |
| 3,145,444 | 8/1964 | Brown et al. | 425/456 |
| 3,507,015 | 4/1970 | Heatlie | 425/64 |
| 3,585,911 | 6/1971 | Vlasic | 404/98 |
| 3,685,405 | 9/1972 | McDonald et al. | 425/64 |
| 3,733,141 | 5/1973 | James | 404/98 |
| 3,779,662 | 12/1973 | Smith | 404/98 |

FOREIGN PATENTS OR APPLICATIONS

| | | | |
|---|---|---|---|
| 637,408 | 2/1962 | Canada | 425/64 |

*Primary Examiner*—Francis S. Husar
*Assistant Examiner*—John McQuade
*Attorney, Agent, or Firm*—Beaman & Beaman

[57] ABSTRACT

A slip form or screed for forming elongated concrete formations, such as a highway barrier wall wherein a concrete receiving hopper is located forwardly of the slip form, and the front wall of the hopper is provided with a hinged gate pivotal between open and closed positions. The gate structure permits stationary objects to enter the hopper and slip form as to become a part of the formed concrete formation, and the gate structure includes concrete retaining means to confine the concrete when the gate is opened, and control the flow of concrete forwardly through the opening when stationary objects are received within the form.

15 Claims, 10 Drawing Figures

SLIP FORM HAVING HINGED GATE MEANS

BACKGROUND OF THE INVENTION

The invention pertains to the field of slip form molds, or screeds and particularly to means for incorporating stationary objects into the slip form molded formation.

Elongated concrete formations, such as walls, highway barrier walls, and the like can be economically formed by continuously moving slip forms commonly known as screeds. Such apparatus includes an open ended form having a hopper at the forward end receiving concrete. As the screed, which is mounted upon a movable vehicle or carriage, moves, the concrete within the hopper enters the screed and is formed into the desired shape. Vibrators and compacting apparatus is utilized within the slip form to compress and settle the concrete, and this vibration, in conjunction with a low water-to-cement ratio, permits a sufficiently "stiff" formation to be molded capable of retaining the desired shape upon withdrawal of the screed.

In my U.S. Pat. No. 3,792,133 I disclose apparatus of the aforementioned type used in the construction of highway barrier wall.

When constructing concrete structures by slip forming, particularly those of significant height, such as above two feet, it is often desirable to introduce reinforcement rod or mesh, electrical connections, special supporting structure, and other stationary elements into the concrete formation, and when constructing highway barrier wall, it is common to incorporate such elements into the wall as well as to mount lamps upon the barrier wall, and such lamps require electrical conduits and bases to be incorporated into the wall during forming.

While it is known to provide slip forms, and their hoppers, with means for introducing reinforcing into the slip form, and removable panels have been used in slip form hoppers as shown in my U.S. Pat. No. 3,792,133, it has heretofore not been possible to readily introduce stationary objects into the screed without losing a significant amount of concrete through the hopper entrance opening, and, in the past, many problems have been encountered in endeavoring to incorporate stationary objects into slip formed walls.

SUMMARY OF THE INVENTION

It is an object of the invention to provide a concrete slip form or screed apparatus having gate structure which permits stationary objects, even of considerable size, to enter the hopper and screed without the loss of concrete.

A further object of the invention is to provide a screed gate of economical construction and fabrication which may be readily opened and closed, and effectively retains and controls concrete flowing through the hopper access opening during the acceptance by the screed of a stationary object for incorporation into the molded form.

In the practice of the invention the forward or front wall of the screed hopper is provided with an opening having upper and lower portions. The hopper opening is of a configuration substantially corresponding to the cross-sectional configuration of the screed, and in alignment with the cavity thereof. Thus, stationary objects entering the hopper and screed through the opening are in alignment with the resultant formed concrete structure.

The hopper opening is provided with gate structure which includes a door hinged about a horizontal axis located at the upper edge of the opening. An expansible motor pivots the door between open and closed positions. Concrete retaining walls affixed adjacent the hopper front wall at the outer edges of the opening extend forwardly in substantially parallel relationship to confine concrete which may flow forwardly through the opening when the door is opened.

The concrete retaining walls are of a configuration corresponding to the hopper opening, and both the opening and the concrete retaining walls include upper portions having substantially parallel relationships, while the lower portions diverge in a downward direction.

The concrete retaining walls extend forwardly a sufficient extent to confine concrete flowing forwardly through the opening; and the lower edge of the door, which is disposed adjacent the intersection of the opening upper and lower portions when the door is closed, is preferably provided with a forwardly extending plate to confine, in an upward direction, concrete which may flow forwardly through the lower portion of the opening when the door is closed.

The relationship of the components constituting the screed gate are such that a wide range of sizes and shapes of stationary objects may enter the hopper and screed without loss of concrete, and the operation of the door permits close regulation of the gate, and the most efficient operation of the apparatus with a minimum loss of concrete.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
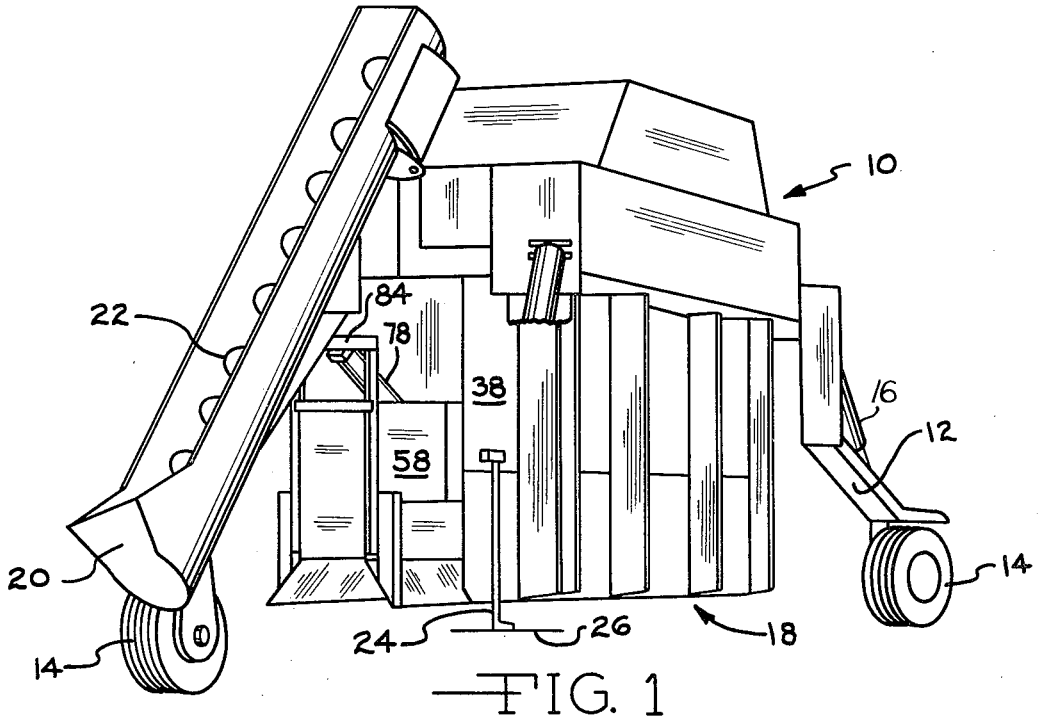
FIG. 1 is a perspective front and side view of slip form apparatus utilizing the slip form and gate in accord with the invention.

The apparatus with which a screed formed in accord with the invention may be used is illustrated in FIG. 1. The vehicle or carrier for the slip form is generally represented at 10. The disclosed embodiment of slip form is for the purpose of pouring highway barrier walls. Such walls may be of a height as great as five feet, and as the slip form or screed is mounted below the vehicle, the vehicle is mounted upon pivotal elongated legs 12 supporting wheels 14. The angular relationship of the legs to the vehicle body is adjusted by expansible motor cylinders 16, and in this manner the vertical position of the slip form or screed 18 may be regulated, as the screed is attached to the underside of the vehicle body. Vehicles of the disclosed type are of known construction, one manufacturer being the Huron Manufacturing Company of Huron, South Dakota.

The apparatus also includes a conveyor 20 having a screw auger 22 which is capable of lifting concrete to a sufficient elevation for dumping into the screed hopper. Mixed concrete is introduced into the lower region of the conveyor, usually by ready-mix concrete trucks, and the entire apparatus moves in the direction of the wall to be poured upon the wheels 14. Vertical sensing of the terrain, and other control of the screed, for instance if a vertically adjustable sidewall screed is used, may be achieved by sensing devices 24 engaging a guideline 26 anchored adjacent the path of movement of the apparatus, as is well known.

The screed apparatus 18 utilized in the concept of the invention will be appreciated from FIGS. 2 through 10.

The screed or slip form includes a rear portion consisting of sidewalls 28 reinforced by vertically disposed ribs 30. The screed includes an open front end 32, FIG. 6, an open rear end 34, a top wall 36 which may be inclined downwardly from the front to the rear, and the bottom of the screed is open so that the formed concrete wall structure may rest upon a preformed foundation, not shown. As the illustrated embodiment is for the purpose of pouring highway barrier wall, the upper portion of the sidewalls 28 are substantially vertical, although converging upwardly to a slight degree, while the lower portion of the walls 28 diverge in a downward direction at a different oblique angle than the upper portion of the slip form sidewalls, as will be apparent from FIG. 10.

At the forward end of the slip form a hopper is defined as generally indicated at 38. The hopper is open at its upper end, and the upper end communicates with the upper end of the conveyor 20. For instance, the upper end of the conveyor may be disposed directly above the hopper 38 such that concrete conveyed upwardly by the conveyor will fall directly into the hopper.

The hopper 38 is of a larger vertical cross section than the cavity of the slip form, and vibrators, not shown, usually extend into the hopper, and into the slip form cavity, to vibrate the concrete as it is formed by the slip form walls to assure a heavy and uniform density of formed wall.

Figure 6:
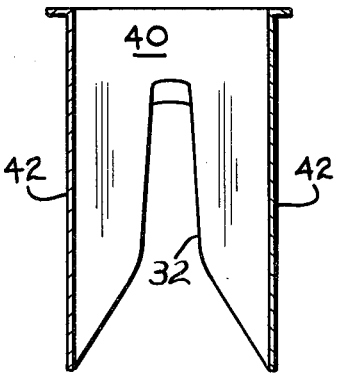
FIG. 6 is an elevational, sectional view as taken through the hopper along section VI—VI of FIG. 2.
Figure 10:
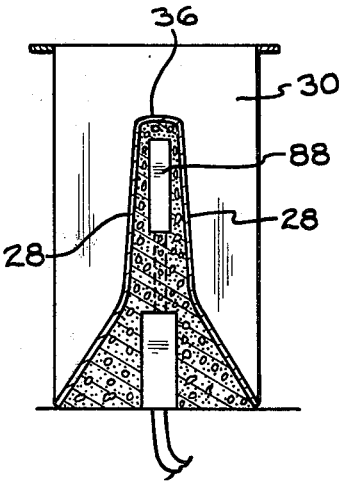
FIG. 10 is an elevational, sectional view as taken along section X—X of FIG. 9.

The hopper 38 includes a rear wall 40 having an opening defined therein conforming to the front end opening of the walls 28 and thereby, as apparent from FIG. 6, corresponds to the configuration of the cavity of the slip form. The hopper also includes sidewalls 42 and a front wall 44. The bottom of the hopper is open.

The hopper front wall 44 is provided with an opening 46 which is in forward alignment with the cavity of the slip form. The configuration of the opening 46 is best appreciated from FIG. 5 wherein the opening includes an upper portion 48 and a lower portion 50. The upper portion 48 is defined by a horizontal upper edge 52, and spaced, parallel, vertical lateral edges 54. The opening lower portion 50 is defined by obliquely disposed edges 56 intersecting the lateral edges 54 and diverging downwardly. Thus, it will be appreciated that the configuration ration of the opening 46 substantially corresponds to the configuration of the slip form cavity as apparent from FIGS. 6 and 10.

A pair of concrete retaining walls 58 extend forwardly from the hopper front wall 44. Each wall 58 includes an upper portion 60, a lower portion 62, a rear edge 64, a forward edge 66, and an upper edge 68. The rear edges 64 of the walls are affixed to the hopper front wall 44 adjacent the opening 46, and it will be appreciated that the configuration of the wall portions 58 substantially corresponds to the configuration of the opening lateral edges 54 and 56. Preferably, the inner surfaces of the walls 58 are in alignment with the lateral edges of the associated opening portions. The upper edge 68 of the walls is at a vertical position substantially corresponding to the upper edge 52 of the opening, and the forward extension of the walls, i.e., the distance between front edge 66 and rear edge 64 is greater than the vertical dimension of the opening portion 48.

The upper portion 48 of the opening 46 is selectively closed by a door 70 hinged adjacent the opening upper edge 52 by hinge structure 72 defining a horizontal hinged axis. The door includes a lower edge 74 disposed adjacent the intersection of the opening lateral edge 54 and 66, and the horizontal lower edge includes a concrete confining plate portion 76 attached thereto and extending forwardly at substantially right angles to the general plane of the door 70. As indicated in FIG. 4, the portion 76 may be formed of the same material as the door 70 and formed by a right angle bend.

Figure 2:
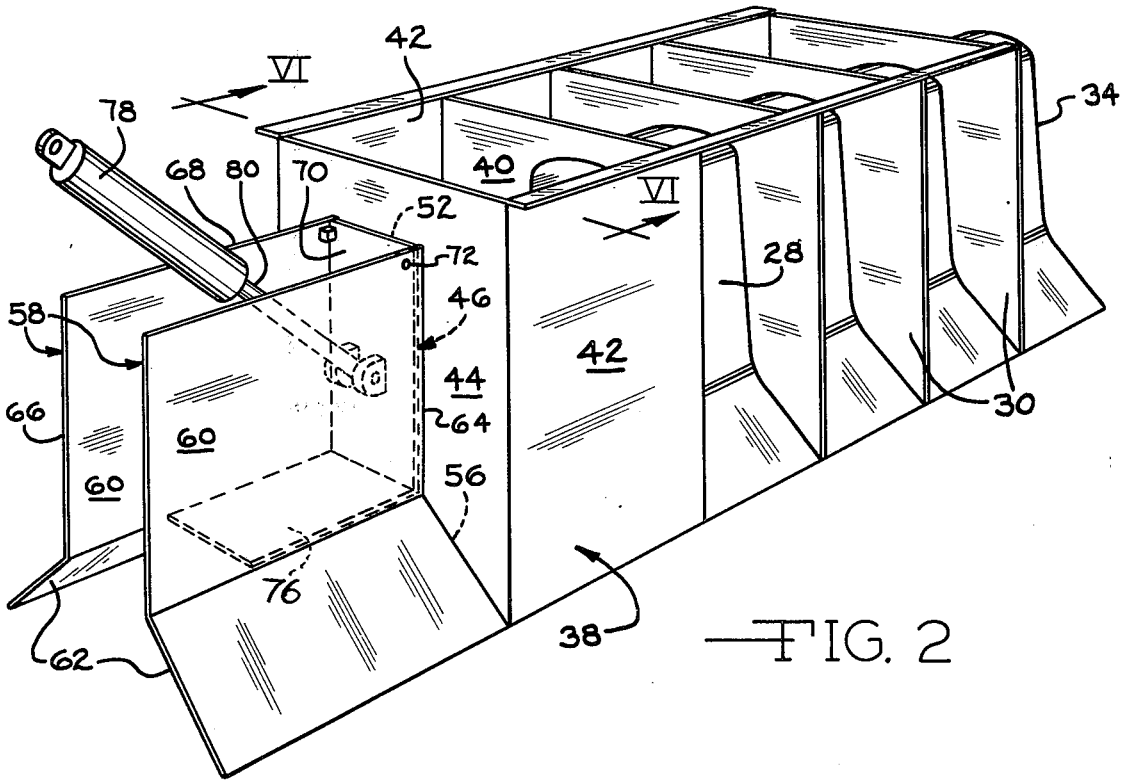
FIG. 2 is a perspective view of a slip form constructed in accord with the invention, the door being illustrated in the closed position.
Figure 3:
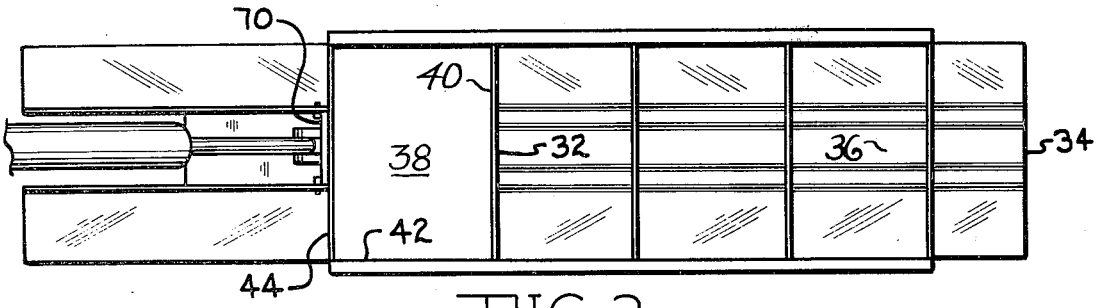
FIG. 3 is a top view of the slip form and gate.
Figure 4:
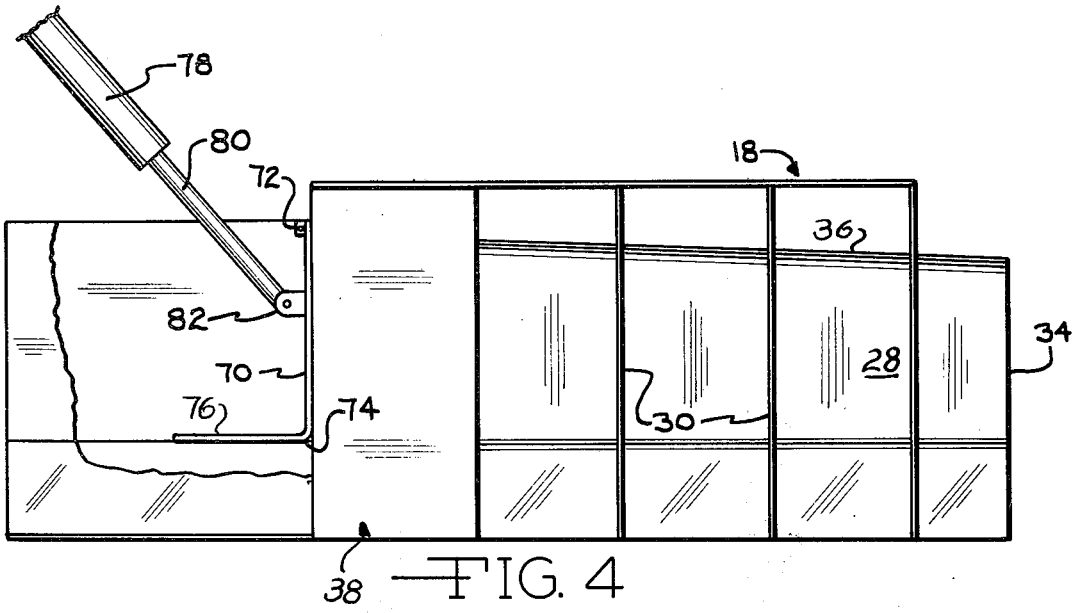
FIG. 4 is a side, elevational view of the slip form and gate, the door being shown in a closed position.
Figure 5:
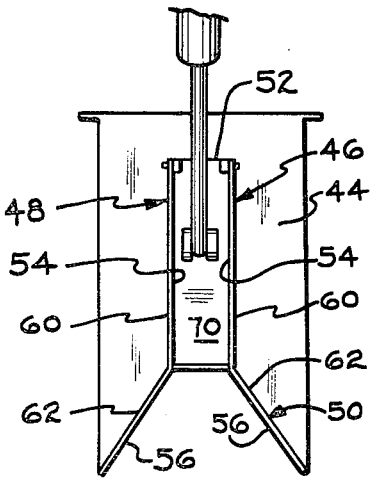
FIG. 5 is an elevational front view of the screed gate with the door in the closed position.
Figure 7:
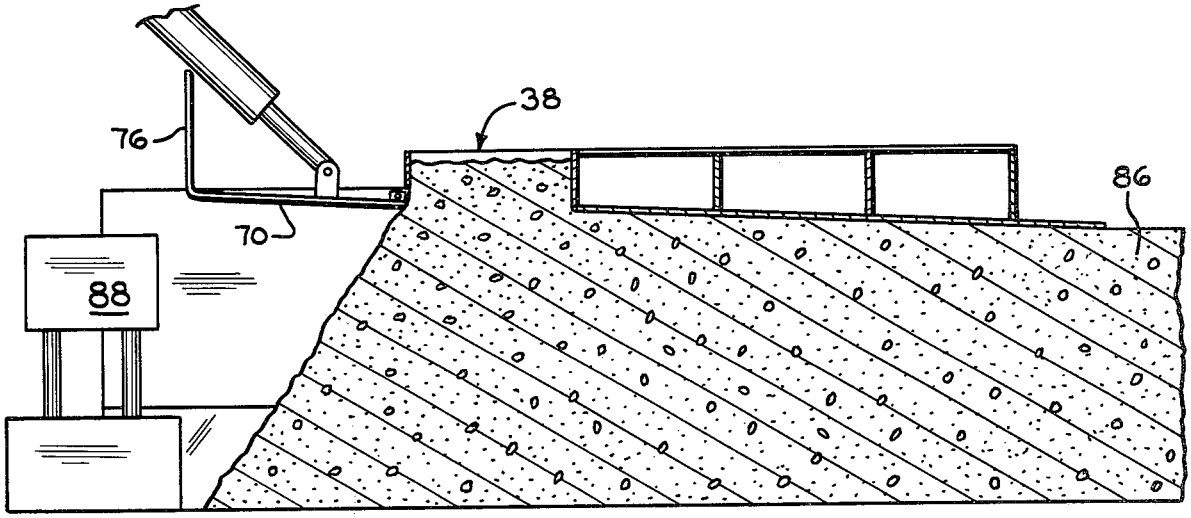
FIG. 7 is a side, elevational view of the screed in use with the door open and a stationary object initially entering the screed gate.

Movement of the door 70 about its horizontal hinge axis between the closed position of FIGS. 2 through 4, and the open position as shown in FIG. 7, is accomplished by an expansible chamber motor, in the form of a cylinder 78 having an extendible piston 80. Suitable pivot mounting brackets 82 are defined on the door for cooperation with the piston, and a mounting bracket 84, FIG. 1, supports the upper end of the cylinder. For purpose of clarity the bracket 84 is not shown in the other drawing figures. Fluid lines, and controls, not shown, of conventional nature, are used to extend and retract the piston 80 to pivot the door 70 between the closed and open positions.

In use, the screed door 70 will usually be closed, as shown in FIG. 4, and concrete is introduced from the conveyor 20 into the hopper 38. The concrete is vibrated and the vehicle 10 carries the screed 18 in the direction of the wall to be formed. The formed wall 86 leaves the rear end of the screed as apparent in FIGS. 7 through 9.

Figure 9:
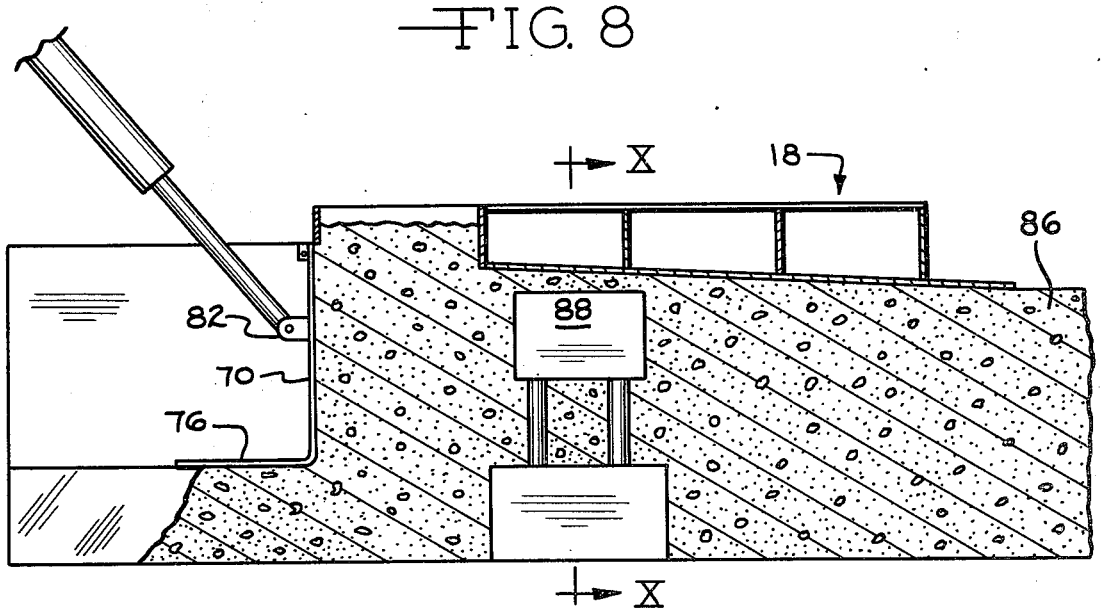
FIG. 9 is an elevational view of the stationary object completely received and enclosed within the slip form.

When the door 70 is closed, concrete cannot flow forwardly through the upper portion 48 of the opening 46 as the upper portion of the opening is closed by the door. It is possible for the concrete to flow slightly forward under the door lower edge 74, as shown in FIG. 9, but the viscosity of the concrete, and the confining plate 76, prevent this forwardly flowing concrete from rising in front of the door 70 or plate 76 as to impede door operation. Of course, the lateral flow of the concrete through the opening lower portion is confined by the retaining wall portions 62, and the forward extension of the walls 58 is considerably greater than the forward flow of the concrete through the opening lower portion and thus no concrete is wasted. By maintaining the lower portion of the opening open, introduction of reinforcement adjacent the base of the wall is possible, and likewise, reinforcing studs which often extend upwardly into the screed from the preformed base may enter the screed without requiring door operation.

When it is desired to incorporate a large stationary object, such as light base 88, into the formed wall, the door 70 is pivoted to the open position by the piston 80 as shown in FIG. 7. The operation of the door 70 will occur as the light base enters between the walls 58, and while the opening of the door permits the concrete within the hopper to flow forward as illustrated, the forward extension of the walls 58 is sufficient to confine this momentary forward flow.

As the screed continues to move toward the light base, the engagement of the forward flowing concrete with the stationary object impedes the concrete flow forward, and the concrete will flow about the light base. Due to the resistance produced by the light base with respect to the forward flow of concrete, the front angle of flow becomes more vertical as the light base enters the hopper as apparent in FIG. 8.

Figure 8:
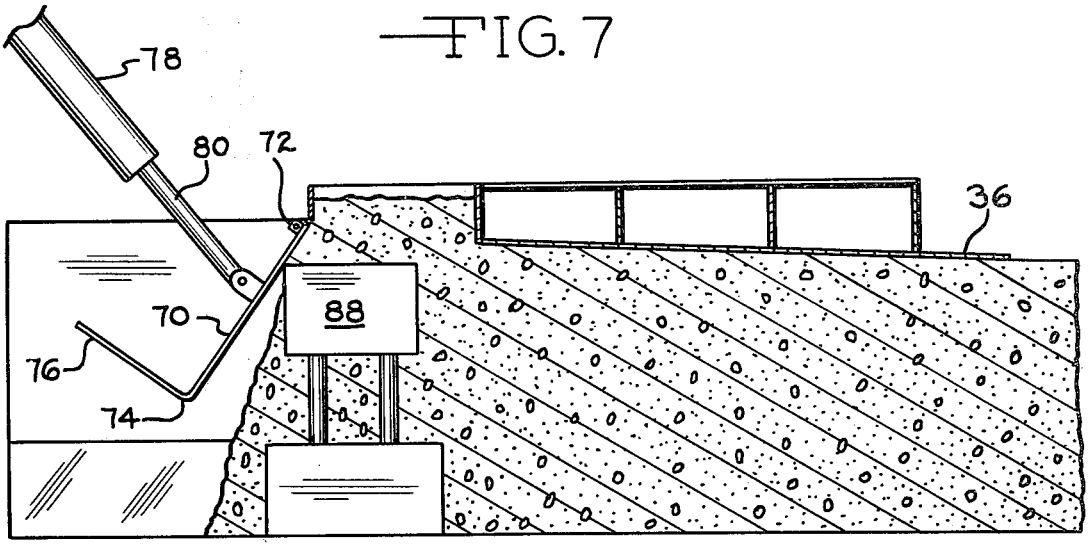
FIG. 8 is a sectional, elevational view similar to FIG. 7 illustrating the stationary object substantially received within the hopper, and the gate door partially closed.

As the light base enters the hopper 38 the door 70 is slowly closed "behind" the light base, FIG. 8, and upon the light base being fully received within the hopper, the door may be swung to the fully closed position of FIG. 9. The screed apparatus is thus returned to normal and the screed passes over the light base incorporating the same into the formed wall 86.

After the screed has traveled past the light base, and prior to the concrete hardening, that portion of the light base which is to be exposed is manually uncovered by removing the desired portion of concrete.

It is therefore appreciated that the screed apparatus using the hopper opening and gate in accord with the invention is capable of permitting stationary objects to enter the slip form without the loss of concrete around the wall edges 66, even though the stationary object may be of a height substantially corresponding to that of the wall, as is the case with the illustrated light base. Reinforcing structure may be employed with the walls 58 to prevent lateral deflection of the walls due to the weight of concrete therein when the door is opened, as in FIG. 7, and such reinforcing structure may take any conventional form.

As is apparent from the drawings, the width of the door 70 and plate portion 76 substantially corresponds to the spacing between the wall portions 60. Thus, as the door 70 is swung to the open position of FIG. 7, or a partially open position, as shown in FIG. 8, concrete cannot escape around the edges of the door to impede door operation. Likewise, as the door confining portion 76 is disposed adjacent the wall portions 60, when the door is in the closed position, the concrete cannot flow upwardly between the wall portions when the door is closed, as in FIG. 9.

It is appreciated that various modifications to the inventive concept may be apparent to those skilled in the art without departing from the scope of the invention.

I claim:

1. A slip form for forming concrete walls comprising, in combination, an elongated wall forming form having spaced side walls defining a cavity, an open front end, an open rear end and an open bottom, a concrete receiving hopper defined at said form front end in communication therewith, said hopper having a front wall, an opening defined in said front wall in alignment with the length of said form cavity capable of receiving stationary objects to be molded into the wall, said opening having upper and lower portions and lateral edges, an access door located adjacent said hopper front wall selectively movable between open and closed positions with respect to, at least, said opening's upper portion selectively providing access to said hopper and form cavity for stationary objects to be molded into the wall, operating means connected to said door for translating said door between said open and closed positions, concrete retaining means comprising a pair of vertically extending spaced walls extending forwardly from said hopper front wall adjacent said opening and located on each lateral side thereof, each wall having a rear edge disposed adjacent said hopper front wall and adjacent a lateral edge of said opening and extending in a forward direction away from said front wall.

2. In a slip form for forming concrete walls as in claim 1, said opening having an upper edge, hinge means mounted adjacent said hopper front wall adjacent said opening upper edge defining a substantially horizontal hinge axis, said door being mounted on said hinge means for pivotal movement about said hinge axis between said open and closed positions under control of said operating means.

3. In a slip form for forming concrete walls as in claim 2 wherein said door is of such vertical height when in the closed position as to close only said opening upper portion.

4. In a slip form for forming concrete walls as in claim 3, said door having a lower edge, forwardly extending concrete confining means defined on said door adjacent said lower edge extending forwardly of said door and opening when said door is in said closed position.

5. In a slip form for forming concrete walls as in claim 4 wherein said concrete confining means comprises a substantially flat plate generally horizontally disposed when said door is in said closed position.

6. In a slip form for forming concrete walls as in claim 2 wherein said operating means comprises an expansible chamber motor.

7. A slip form for forming concrete walls comprising, in combination, an elongated wall forming form having spaced side walls defining a cavity, an open front end, an open rear end and an open bottom, a concrete receiving hopper defined at said form front end in communication therewith, said hopper having a front wall, an opening defined in said front wall in alignment with the length of said form cavity capable of receiving stationary objects to be molded into the wall, said opening having upper and lower portions and lateral edges, an access door located adjacent said hopper front wall selectively movable between open and closed positions with respect to, at least, said opening's upper portion selectively providing the access to said hopper and form cavity for stationary objects to be molded into the wall, a pair of spaced concrete retaining walls mounted adjacent said hopper and extending forwardly from said hopper front wall and of a vertical height substantially equal to the vertical height of said opening, each wall having a rear edge located adjacent a lateral edge of said opening whereby concrete flowing forward through said opening is retained in alignment with said form cavity, and operating means connected to said door for translating said door between said open and closed positions.

8. In a slip form for forming concrete walls as in claim 7, said opening having an upper edge, hinge means mounted adjacent said hopper front wall adjacent said opening upper edge defining a substantially horizontal hinge axis, said door being mounted on said hinge means for pivotal movement about said hinge axis between said open and closed positions under control of said operating means.

9. In a slip form for forming concrete walls as in claim 8 wherein said door has a path of movement between said concrete retaining walls when hinging about said hinge axis.

10. In a slip form for forming concrete walls as in claim 9 wherein said opening upper portion is defined by substantially parallel vertical lateral edges and said concrete retaining walls in alignment with the forward projection of said opening upper portion are planar and parallel and spaced apart a distance slightly greater than the width of said door.

11. In a slip form for forming concrete walls as in claim 9, said door having a lower edge, a concrete confining plate defined on said door at said lower edge extending forwardly away from said hopper and substantially horizontally disposed when said door is in the closed position.

12. In a slip form for forming concrete walls as in claim 9 wherein said opening means comprises an expansible chamber motor.

13. In a slip form for forming concrete walls as in claim 7 wherein the lateral edges of the opening lower portion diverge downwardly, each of said concrete retaining walls including an upper portion and a lower portion, said walls upper portions being parallel and substantially vertical, and said walls lower portions corresponding in configuration to said opening lower portion and diverging downwardly.

14. In a slip form for forming concrete walls as in claim 13 wherein said door includes a lower edge disposed adjacent the intersection of said openings upper and lower portions when said door is in the closed position.

15. In a slip form for forming concrete walls as in claim 14, a concrete confining plate defined on said door at said lower edge extending forwardly away from said hopper and substantially horizontally disposed when said door is in the closed position.

* * * * *